166-274 SR
7/1/86 XR 4,597,442

United States Patent [19]
Dilgren et al.
[11] Patent Number: 4,597,442
[45] Date of Patent: Jul. 1, 1986

[54] RESERVOIR PREFLUSHING PROCESS FOR INCREASING THE RATE OF SURFACTANT TRANSPORT IN DISPLACING OIL WITH INJECTED STEAM AND STEAM-FOAMING SURFACTANT

[75] Inventors: Richard E. Dilgren; Hon C. Lau; George J. Hirasaki, all of Houston, Tex.

[73] Assignee: Shell Oil Company, Houston, Tex.

[21] Appl. No.: 705,773

[22] Filed: Feb. 26, 1985

[51] Int. Cl.[4] ..... E21B 43/22; E21B 43/24

[52] U.S. Cl. ..... 166/272; 166/273; 166/274; 166/303

[58] Field of Search ..... 166/272, 273, 274, 303, 166/309

[56] References Cited

U.S. PATENT DOCUMENTS 3,087,539 4/1963 Maurer, Jr. ..... 166/274
3,369,602 2/1968 Fallgatter et al. ..... 166/273
3,437,141 4/1969 Brandner et al. ..... 166/273
4,074,755 2/1978 Hill et al. ..... 166/273 X
4,086,964 5/1978 Dilgren et al. ..... 166/272
4,129,182 12/1978 Dabbous ..... 166/273 X
4,274,488 6/1981 Hedges et al. ..... 166/273
4,393,937 7/1983 Dilgren et al. ..... 166/272
4,532,993 8/1985 Dilgren et al. ..... 166/303

FOREIGN PATENT DOCUMENTS 2138869 10/1984 United Kingdom ..... 166/272

*Primary Examiner*—George A. Suchfield

[57] ABSTRACT

In a process in which steam and steam-foaming surfactant are injected into a subterranean reservoir having significant cation-exchange capacity, the rate of transport of the steam-foaming surfactant is increased by a prior injection of an aqueous liquid solution of surfactant and monovalent cation salt.

10 Claims, 2 Drawing Figures

RESERVOIR PREFLUSHING PROCESS FOR INCREASING THE RATE OF SURFACTANT TRANSPORT IN DISPLACING OIL WITH INJECTED STEAM AND STEAM-FOAMING SURFACTANT

BACKGROUND OF THE INVENTION

The invention relates to displacing oil within a subterranean reservoir by injecting steam and steam foaming surfactant. More particularly, the invention relates to injecting a preflushing aqueous liquid solution for increasing the rate at which the injected surfactant is propagated through the reservoir by reducing the effects of an ion-exchange by the reservoir rocks.

Numerous processes have been developed for displacing oil within a subterranean reservoir by injecting mixtures of steam and steam-foaming surfactants. For example, U.S. Pat. No. 4,086,964 by R. E. Dilgren, G. J. Hirasaki, D. G. Whitten and H. J. Hill describes such a process for steaming a reservoir susceptible to gravity override until a steam breakthrough from injection to production wells is at least imminent then injecting a steam-foam-forming mixture of steam, noncondensible gas, aqueous electrolyte and steam-foaming surfactant, to maintain an increased pressure within the steam channel without plugging or fracturing the reservoir. U.S. Pat. No. 4,393,937 by R. E. Dilgren and K. B. Owens describes a process for displacing oil within a subterranean reservoir by injecting a steam-foam-forming composition comprising steam, noncondensible gas, aqueous electrolyte and olefin sulfonate surfactant. The disclosures of those patents are incorporated herein by reference.

SUMMARY OF THE INVENTION

The present invention relates to an improvement in a process in which oil is displaced by injecting steam and steam-foaming surfactant into a reservoir in which the transporting of the steam-foaming surfactant is impeded by a tendency of the reservoir rocks to exchange multivalent cations for monovalent cations. The improvement is effected by injecting a pretreatment aqueous liquid solution into the reservoir before injecting at least a portion of the mixture of steam and steam-foaming surfactants. The pretreatment solution contains a proportion of dissolved monovalent cation salt effective for exchanging monovalent cations for multivalent cations on the reservoir rocks and displacing the multivalent cations out of the zone to be swept by the steam and steam-foaming surfactant.

DESCRIPTION OF THE INVENTION

Figure 1:
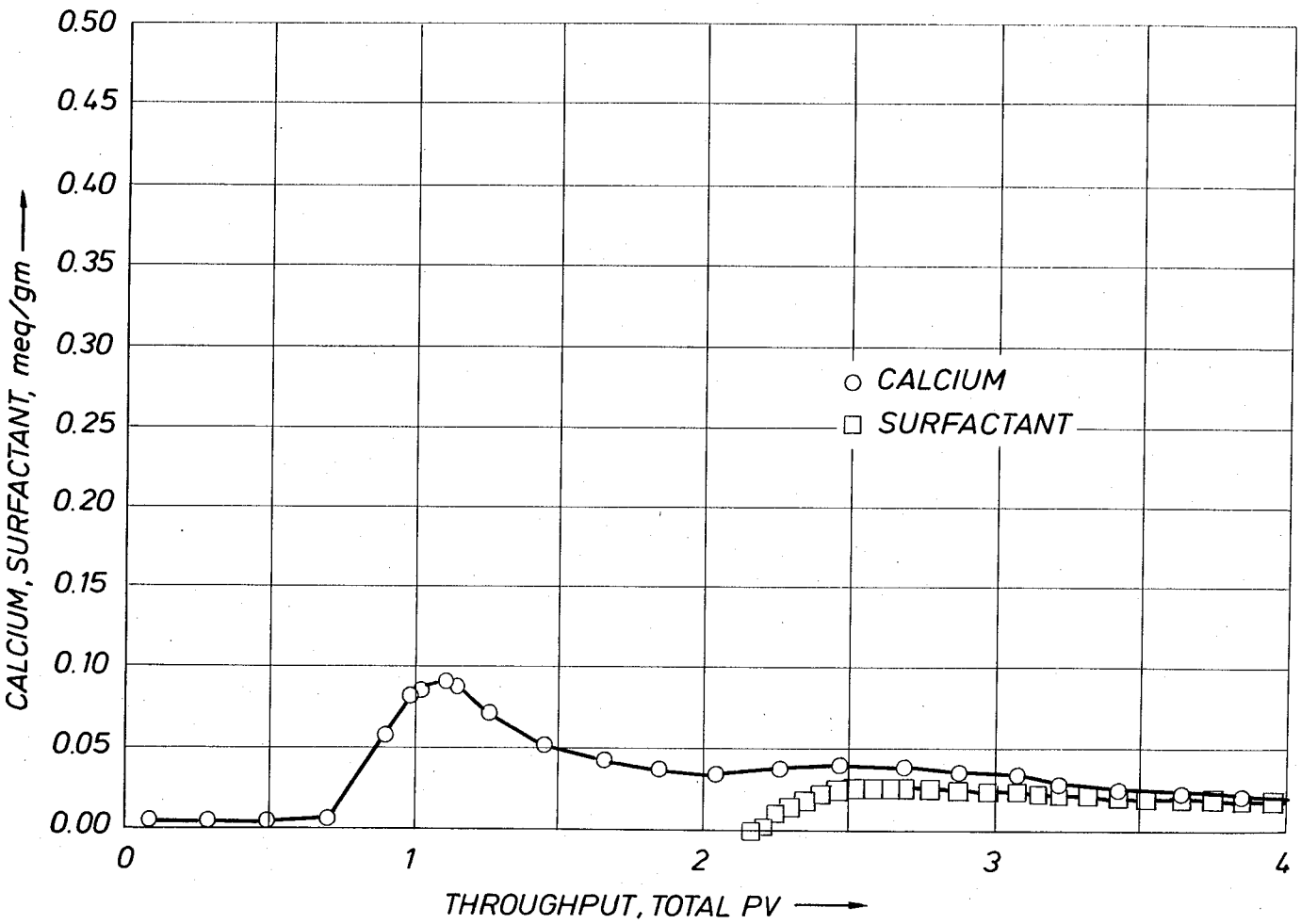
FIGS. 1 and 2 show plots of calcium and surfactant concentrations with volume of solutions flowed through cores of reservoir sand, without and with preflush, respectively.

In a process for displacing oil within a subterranean reservoir by injecting a mixture of steam and steam-foaming surfactant, an efficient transport of the surfactant through the reservoir is important. The rate at which foam moves through the reservoir cannot exceed the rate at which that surfactant is transported.

Many subterranean reservoirs have an ion-exchange capacity which is sufficient to impede the transport of a steam-foaming surfactant through the reservoir. Such an ion-exchange is due to a mechanism by which monovalent ions in an injected surfactant solution (such as the aqueous phase of a mixture of steam and steam-foaming surfactant) displace multivalent cations from the clays and the like ion-exchange sites on the reservoir rocks. This exchange results in a buildup of the multivalent cation content in the injected surfactant solution.

Of all the mechanisms affecting the surfactant transport in a steam foam process, ion exchange is one of the most critical mechanisms. Other mechanisms including adsorption, partitioning, precipitation, and possibly spreading behavior of the oil at the gas/aqueous interface, are directly related to the multivalent cation concentration of the aqueous liquid phase.

In the presence of oil, a buildup of multivalent ions such as calcium ions, due to an ion exchange, increases the partitioning of the surfactant into the oleic phase. This is due to normal surfactant micelles in the aqueous phase being converted to inverted micelles in the oleic phase. The surfactant transport is thus retarded due to the partitioning of surfactant into trapped droplets of oil.

In general, the present process is applicable to substantially any reservoir in which oil is to be displaced by injecting steam and steam foaming surfactant, but the transport of that surfactant is significantly impeded by ion-exchange with the reservoir rock. The occurrence of such an impeding of the surfactant transport can, of course, be determined in numerous known ways such as those based on logging measurements, core measurements, and the like. In addition, it can readily be detected by monitoring the concentration with time with which a steam-foaming surfactant is transported through a reservoir and into a production location. The present process is particularly useful in reservoirs which are susceptible to a gravity override and the path followed by injected steam is not confined to one or more relatively thin layers of high absolute permeability.

We have discovered that in reservoirs in which a steam-foam displacement of oil is impeded by the ion-exchange capacity of the reservoir rocks, the rate at which a wave of ion-exchange-induced multivalent cation concentration within an injected liquid, increases with increases in the initial monovalent ion concentration of that liquid.

The extent of that increase is such that an aqueous preflush solution having a monovalent cation concentration, effective for initiating an ion exchange is capable of increasing the rate at which a steam-foaming surfactant is subsequently propagated through the reservoir in such a preflush solution that monovalent cation concentration preferably exceeds that of the mixture of steam and steam-foaming surfactant which is to be injected after the preflush solution.

Monovalent cation salts, suitable for use in such pretreatment solution, can comprise substantially any alkali metal or ammonium salts containing anions such as chloride, nitrate, and the like, which are compatible with the anions of the other fluids in the reservoir. Sodium chloride is a particularly suitable salt. The concentrations of the monovalent cation salts are preferably in the order of about 1 to 15% by weight of the aqueous liquid and preferably are significantly greater than such concentrations in the mixture of steam and steam-foaming surfactant injected after the preflush.

In numerous reservoir situations the present preflush solution is effective without a surfactant; however, in situations in which a combination of the reservoir thickness or permeability and reservoir or well equipment pressure limitations, are apt to cause a significant gravity overriding of an injected mixture of steam and steam-foaming surfactant, a foaming surfactant can advantageously be included within the present type of preflush solution.

A surfactant suitable for use in the present preflush solution preferably comprises one having a good stability at steam temperature and a capability of significantly reducing the mobility of steam. The concentration of surfactant can suitably be about 0.05 to 1% by weight of the aqueous liquid. Where needed, or desired, the preflush solution can be heated to a temperature at least substantially equalling that at which the mixture of steam and steam-foaming surfactant is to be injected and mixed with enough steam to form a foam or substantially homogeneous mixture of steam and preflush solution within the reservoir. In such a reservoir situation, the pretreatment fluid can advantageously be injected along with a latter portion of steam, the injection of which is to be replaced by an injection of steam mixed with steam-foaming surfactant. When a surfactant is included in the present type preflush solution, its main function is to improve the distribution of the preflush solution. This can be caused by (1) generation of foam which improves the injection profile and vertical sweep of preflush solution and/or (2) the transport of preflush solution upward into the steam zone by moving liquid lamelae in a substantially homogeneous mixture of steam and liquid.

The steam-foaming surfactants suitable for use in the present process can comprise substantially any which are effective for foaming steam. As known to those skilled in the art, some of the surfactants effective for foaming a gas such as steam are also effective for interfacial tension lowering, while others are effective for only one or the other of such functions. Examples of suitable steam-foaming surfactants include substantially any which are capable of providing a relatively low steam mobility factor, as described in the cross-referenced U.S. Pat. Nos. 4,086,964 and 4,393,937 listed above. The surfactants such as the dodecylbenzenesulfonate surfactants and olefin sulfonate surfactants are particularly suitable.

In a preferred procedure, the reservoir is initially steamed with a wet, dry or superheated steam, to increase the temperature of the resevoir while producing oil, either in a substantially continuous drive or a cyclic steam soak type process. In view of the relatively high mobility of steam, the rate of oil production is reduced by a steam breakthrough into a production location, such as an adjoining production well, or by a formation of substantially steam-filled oil-depleted zone in an upper part of the reservoir adjoining a steam soak well. The pretreatment aqueous liquid solution is preferably injected at this time in a volume sufficient to permeate at least a substantial portion of the zone which is, or is soon apt to be, filled with steam. Alternatively, a volume of a mixture of steam and steam-foaming surfactant sufficient to cause a significant increase in the injection pressure and temperature within the reservoir can be injected prior to injecting the preflush solution. The pretreatment fluid is preferably heated to at least near the reservoir temperature prior to its injection. It is preferably injected in a volume amounting to from about 0.05 to 1 pore volume of the portion of the reservoir through which the steam foam will be injected.

The injected mixture of steam and steam-foaming surfactant can be mixed at a surface location and (with or without prefoaming) injected simultaneously or alternately injected in small enough slugs to become substantially homogeneously mixed within a well or the first few feet of the reservoir formation. The mixture of steam and steam-foaming surfactant preferably also contains an effective proportion of noncondensible gas and dissolved electrolyte. In general, the types and proportions of such components are preferably substantially like those discussed in more detail in the cross-referenced patents.

Figure 2:
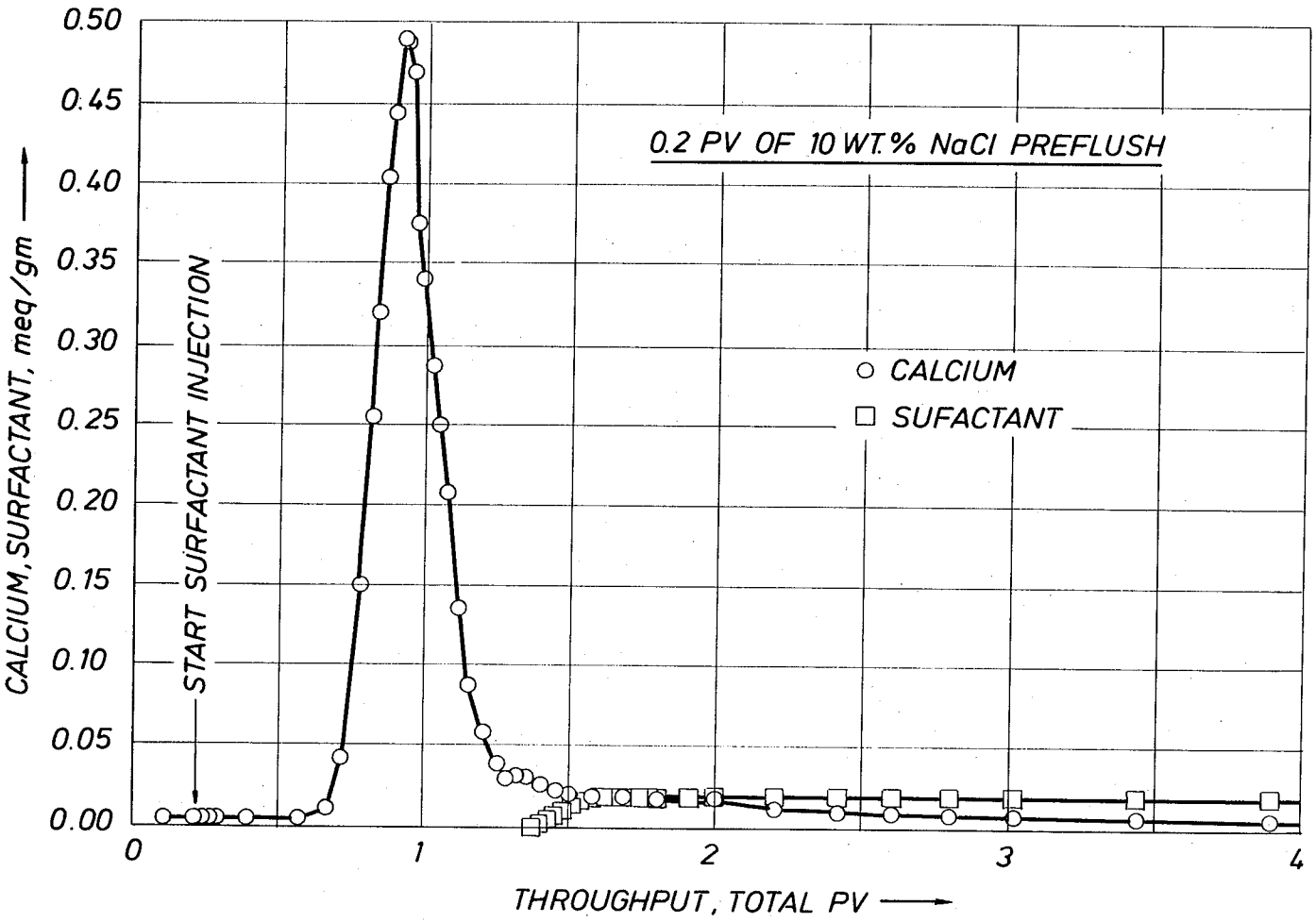

FIGS. 1 and 2 show plots for two corefloods run in a natural sand (Bay Marchand) which has a high cation exchange capacity. Each sand pack was at waterflood residual oil saturation (about 25% of total pore volume) at the beginning of the corefloods. Bishop crude from Kern River and synthetic connate water were used. Under those conditions the clays contain about 80% divalent cations.

In the experiment shown in FIG. 1, the injected fluid was an aqueous solution of 0.5% Enordet AOS 1618, alpha-olefin sulfonate surfactant available from Shell Chemical Company, and 1% NaCl. The Figure shows that as a result of ion-exchange, calcium ion concentration peaked-up. After the peak, $Ca^{++}$decreased slowly. This buildup in $Ca^{++}$caused the surfactant to precipitate and also caused partitioning into the oleic phase. The surfactant breakthrough was substantially delayed.

FIG. 2 shows the results of a similar coreflood following an injection of 0.2 PV of 10% NaCl aqueous preflush. No surfactant was included in the preflush. As seen in the Figure, the preflush caused the $Ca^{++}$to be displaced from the sands much quicker. The $Ca^{++}$concentration decreased rapidly after a much sharper peak and the surfactant retention was much less than was the case without the preflush.

What is claimed is:

1. In a process in which oil is displaced by injecting steam and steam-foaming surfactant into a reservoir in which the transporting of steam-foaming surfactant is impeded by a tendency of the reservoir rocks to exchange multivalent cations for monovalent cations in the injected aqueous liquid component of that mixture, an improvement comprising:

pretreating the reservoir, before injecting at least a portion of the steam and steam-foaming surfactant mixture, by injecting an effective volume of preflush aqueous liquid solution containing both a proportion of dissolved monovalent cation salt that exceeds the monovalent cation concentration which is effective for exchanging monvalent cations for multivalent cations on the reservoir rocks and an interfacial tension lowering surfactant, so that the preflush solution displaces multivalent cations out of the zone to be swept by steam and steam-foaming surfactant; and subsequently injecting a mixture of steam and steam-foaming surfactant into a relatively multivalent cation-depleted portion of the reservoir which was contacted by the preflush solution.

2. The process of claim 1 in which the injected mixture of steam and steam-foaming surfactant also contains noncondensible gas and electrolyte.

3. The process of claim 2 in which a volume of the mixture of steam and steam-foaming surfactant sufficient to cause a significant increase in the injection pressure and temperature within the reservoir is injected prior to injecting the preflush solution.

4. The process of claim 1 in which the preflush solution is injected subsequent to an injection of steam and prior to the injection of a mixture of steam and steam-foaming surfactant.

5. The process of claim 1 in which the mixture of steam and steam-foaming surfactant is injected to displace oil toward a production location in an adjacent well.

6. The process of claim 1 in which the mixture of steam and steam-foaming surfactant and the pretreatment aqueous liquid are injected in cycles in a steam foam soak oil production process.

7. In a process in which oil is displaced by injecting steam and steam-foaming surfactant into a reservoir in which the transporting of steam-foaming surfactant is impeded by a tendency of the reservoir rocks to exchange multivalent cations for monovalent cations in the injected aqueous liquid component of that mixture, an improvement comprising:

pretreating the reservoir, before injecting at least a portion of the steam and steam-foaming surfactant mixture, by injecting a preflush aqueous liquid solution having a volume of about 0.05 to 1 pore volume of the steam foam drive pattern, said solution containing about 0.05 to 1 percent interfacial tension lowering surfactant and containing a proportion of about 1 to 15% by weight of the mixture of steam and steam-foaming surfactant of dissolved monovalent cation salt, which salt concentration exceeds the monovalent cation salt concentration effective for exchanging monovalent cations for multivalent cations on the reservoir rocks; and subsequently injecting a mixture of steam and steam-foaming surfactant into a relatively multivalent cation depleted portion of the reservoir which was contacted by the preflush solution.

8. The process of claim 7 in which the injection of the preflush solution is followed by an injection of steam having a quality of about 30 to 80 percent and containing about 0.05 to 1 percent steam-foam-forming surfactant, 0.5 to 4 percent of sodium chloride and 0.003 to 0.3 percent by mole of noncondensible gas.

9. The process of claim 7 in which the preflush solution is mixed with sufficient steam to form a steam foam.

10. The process of claim 9 in which the surfactant in both the mixture of steam and steam-foaming surfactant and the mixture of preflush solution and steam is at least one olefin sulfonate surfactant.

* * * * *